US006800110B2

(12) United States Patent
Biddulph

(10) Patent No.: US 6,800,110 B2
(45) Date of Patent: Oct. 5, 2004

(54) SYSTEM FOR PRODUCING NOBLE METALS

(76) Inventor: Stuart Biddulph, 1303 Lakeview Dr., Provo, UT (US) 84604

( * ) Notice: Subject to any disclaimer, the term of this patent is extended or adjusted under 35 U.S.C. 154(b) by 194 days.

(21) Appl. No.: 10/252,191

(22) Filed: Sep. 23, 2002

(65) Prior Publication Data

US 2004/0056393 A1 Mar. 25, 2004

(51) Int. Cl.[7] ..... C22B 11/02; C22B 11/12

(52) U.S. Cl. ..... 75/10.12; 75/67; 219/421; 266/97; 373/1

(58) Field of Search ..... 75/10.12, 67; 219/421; 266/97; 373/1

(56) References Cited

U.S. PATENT DOCUMENTS 133,099 A * 11/1872 Hay ..... 420/8

5,948,138 A * 9/1999 Issidorov ..... 75/10.13

* cited by examiner

*Primary Examiner*—Melvyn Andrews
(74) *Attorney, Agent, or Firm*—Kirton & McConkie; Michael F. Krieger

(57) ABSTRACT

A system for producing significant quantities of noble metals from low-grade ore. A mixture of particulate feed containing small amounts of noble metals, a base metal, and activated carbon are placed in a non-conducting container. The container is surrounded by a coiled transmission line and heated via a combustion chamber. Pairs of electrical pulses having equal amplitudes and opposing directions are applied to each end of the transmission line so that the opposing pulses collide within the transmission line, the collision points traveling in a sweeping motion along the transmission line. Other pairs of pulses are sent in repeated cycles of multi-chord pulse trains, each chord having a specific frequency ranging preferably between 5000 to 7000 cycles per second.

37 Claims, 3 Drawing Sheets

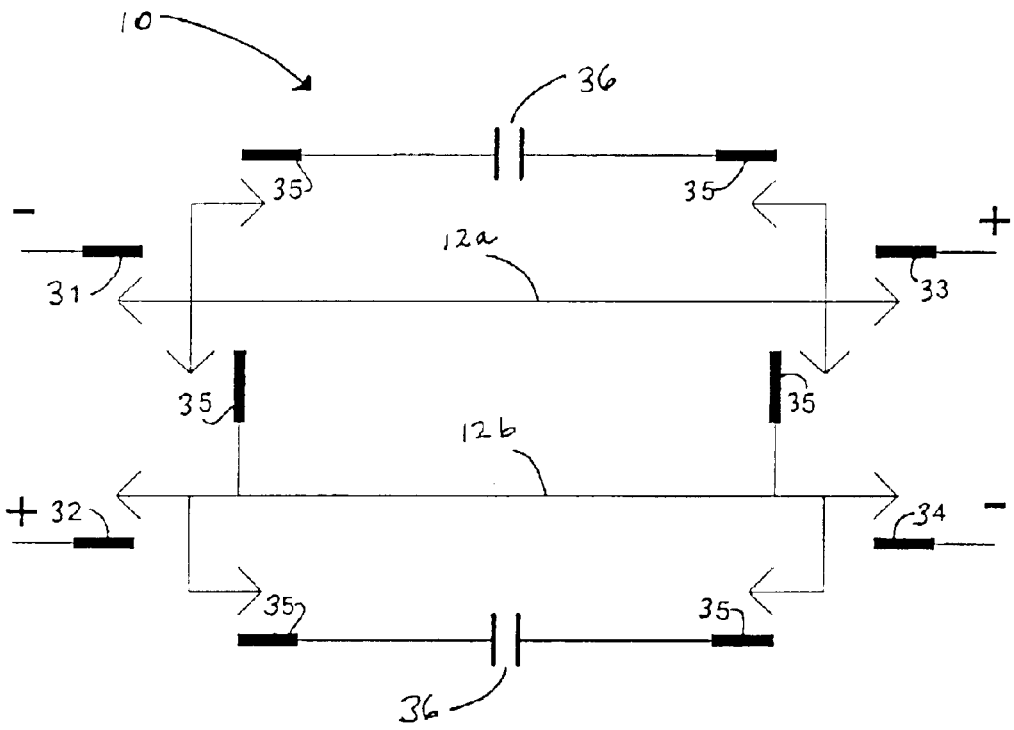

FIG. 6

| | Switch 31 | Switch 32 | Switch 33 | Switch 34 | Switches 35 |
|---|---|---|---|---|---|
| 1 | CLOSE | CLOSE | CLOSE | CLOSE | OPEN |
| 2 | Open | Close | Open | Close | Close |
| 3 | Close | Open | Close | Open | Close |
| 4 | CLOSE | CLOSE | CLOSE | CLOSE | OPEN |
| 5 | Open | Close | Open | Close | Close |
| 6 | Close | Open | Close | Open | Close |
| 7 | CLOSE | CLOSE | CLOSE | CLOSE | OPEN |
| 8 | Open | Close | Open | Close | Close |
| 9 | Close | Open | Close | Open | Close |
| 10 | CLOSE | CLOSE | CLOSE | CLOSE | OPEN |
| 11 | Open | Close | Open | Close | Close |
| 12 | Close | Open | Close | Open | Close |

FIG. 7

SYSTEM FOR PRODUCING NOBLE METALS

BACKGROUND

1. Field of the Invention

The present invention pertains to a system for producing valuable metals from materials containing trace amounts of those valuable metals. In particular, the present invention relates to a system for producing noble metals such as gold, platinum, palladium, and silver from low-grade ore material.

2. Background

There are several ways to retrieve or mine metals from ore. As is well known in the art, mining has historically consisted of hard-rock, open pit, or placer deposit methods. Generally, in the case of hard-rock mining, or open pit mining, higher-grade materials are selected for processing by grinding and concentrating metal-bearing ore. Concentration may be accomplished by floatation, chemical leach, or gravity separation such as sluicing. The rejected materials, or the materials that are left after concentration, are generally placed in tailing piles that are then just left at the mine or mill site. The tailing piles will often still contain small amounts of the desired metals but are nevertheless considered unprofitable to work with further.

The concentrated materials may be further processed by smelting them into the form of a metal bar or cell. Smelting involves heating the concentrated materials with suitable fluxes to the melting point of the metals. The metals are then poured into molds, and the waste material is carried in the flux that comes off in a slag. Heating has been accomplished by a variety of methods such as by gas fire, coke fire, carbon arc, and induction heating—all of which are familiar to those who practice the art.

Besides methods for retrieving or mining metals, there also exist some methods for processing low-grade ore materials (such as that found in tailing piles) that purport to produce more amounts of the desired metals than were originally present in the ore materials. For example, one method produces metals from heavy magnetic black sands that are often recovered with gold from dredging or sluicing operations. First, the finely ground sands are mixed with flour or whole wheat, finely divided (powdered) silver, and potassium nitrate. This mixture is placed in a container or barrel of, for example, a fifty-gallon capacity, and then set on fire so that the mixture burns slowly until all combustion is complete. The mixture is then smelted, along with a soda ash and borax flux (borax being an ore of the element boron), in a silicon carbide crucible placed within a furnace fired by natural gas. The metal obtained from the smelting operation is then parted in an electrolytic silver cell, according to known standard procedures for such separation, and the slimes are then analyzed for noble metals other than silver. This process does not consistently produce significant amounts of the desired metals, however, and thus has been abandoned as commercially useless.

Other methods exist for processing low-grade ore materials such that a greater amount of the desired metals are purportedly produced than were originally present in the ore materials. For example, one such method involves the use of induction furnaces to repeatedly heat a mixture of ore particles and flour. This method is careful to provide an oxygen-free environment within the furnace so that the process of creating the desired metals is not reversed.

SUMMARY OF THE INVENTION

The present invention may generally be characterized as a process or system for producing quantities of noble metals.

The process basically begins with obtaining a feed material containing small amounts of noble metals, mixing the feed material (preferably in a ground or particulate form) with a base metal such as copper and with activated carbon such as charcoal briquettes, and exposing the mixture to a reaction environment that results in the production of significantly greater quantities of noble metals, or other types of valuable metals, than were originally present in the feed.

The reaction environment includes a non-conducting container placed within a combustion chamber and surrounded by a double-wire, coiled transmission line. "Collision pairs," comprising pairs of electrical pulses having equal amplitudes and opposing directions (in other words, each pair comprises a positive pulse and a negative pulse), are repeatedly applied to each end of the transmission line so that the opposing pulses collide within the transmission line and that the collision points travel in a sweeping motion along the length of the transmission line.

Additional positive-negative pulse pairs, herein called "frequency pairs," are sent in multi-chord pulse trains that form a chord having multiple, specific frequencies ranging preferably between 5000 to 7000 cycles per second. These multi-frequency pulse trains are repeated over and over, thus sustaining a multi-frequency chord that exposes the mixture within the container to a multi-frequency magnetic field. The timing of the frequency pairs is preferably controlled by digital signal processing filters that are able to precisely maintain the individual frequencies of the chord by using input from current and voltage sensors in the transmission line.

The collision and frequency pulse pairs are repeatedly applied to the transmission line until the desired amount of metal is produced. In the preferred embodiments, heat is also applied to the mixture in order to facilitate the production of metals.

Accordingly, it is an object of some embodiments of the present invention to provide a commercially valuable process whereby valuable metals are produced from low-grade ore material.

It is another object of some embodiments of the present invention to provide a process for producing noble metals wherein a mixture of activated carbon, a base metal, and feed material containing trace amounts of the desired noble metals are exposed to electrodynamic fields created by a series of electrical pulses that travel along conducting lines surrounding the mixture.

It is yet another object of some embodiments of the present invention to provide a process for producing noble metals wherein a mixture of low-grade ore, carbon, and copper are exposed to a combination of gas heat and of electrodynamic fields that vary at multiple, pre-determined frequencies.

Another object of some embodiments of the present invention is to provide a non-conducting container surrounded by a double-wire, coiled transmission line wherein the container is designed to hold low-grade ore materials, and the transmission line carries repeated electrical pulse collisions and multi-frequency pulses that travel along the transmission line.

BRIEF DESCRIPTION OF THE DRAWINGS

The foregoing and other objects and features of the present invention will become more fully apparent from the accompanying drawings when considered in conjunction with the following description and appended claims. Although the drawings depict only typical embodiments of the invention and are thus not to be deemed as limiting the scope of the invention, the accompanying drawings help explain the invention in added detail.

FIG. 6 shows a circuit diagram that illustrates how the pulses are generated in the preferred embodiments of the present invention.

FIG. 7 shows a table that shows what switches in FIG. 5 are closed in order to generate the pulse collision pairs and frequency pairs in the preferred embodiments of the present invention.

DETAILED DESCRIPTION OF SPECIFIC EMBODIMENTS

Figure 1:
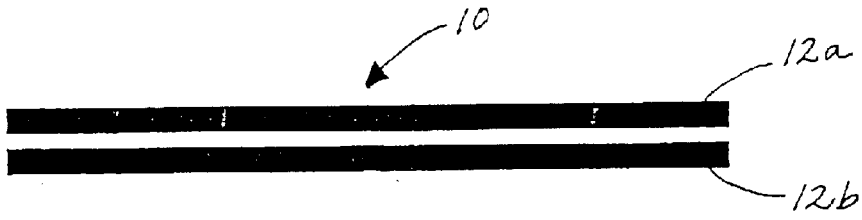
FIG. 1 shows a schematic diagram of an electrical transmission line according to one embodiment of the present invention.

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

The purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are designated by like alphanumeric characters throughout.

The present invention basically begins with obtaining a feed material containing small or trace amounts of noble metals (or other valuable metals desired to be produced from operation of this invention), mixing the feed material (preferably in a ground or particulate form) with a base metal and with activated carbon such as charcoal briquettes, and exposing the resulting mixture to a reaction environment that results in the production of significantly greater quantities of noble metals, or other valuable metals, than were originally present in the feed. Noble metals include the metals such as gold, platinum, palladium, and rhodium (note that the latter is also considered a type of platinum). It should also be noted that this Detailed Description focuses on the production of noble metals because such metals are valuable enough to justify the costs of operating the present invention. However, the present invention may be used to create any metals valuable enough to the producer.

The feed material can be any material in which one or more of the desired noble metals is present in at least a trace amount that will promote the replication of the noble metals using the methods and processes (as further described below) of the present invention. Examples of feed material include low-grade ore materials such as those found in natural deposit, those found in tailing piles left after the concentration step in mining processes, and those found in the slag that results from smelting. Any or all of the public domain art that is available to those skilled in the mining and recovery of metals could be used to provide the feed materials in the present invention.

The base metal is added to the feed material to provide blocks of atomic mass in amounts that, when added to the mass of lighter elements contained in the feed materials (for example, the elements shown in columns 2 through 5 in the table below), substantially sums up to quantities of the atomic mass of the desired noble metal or metals. The masses must sum up in this manner because it is contemplated that the present invention promotes quantum tunneling between nuclei to create new atoms (comprising one or more noble metal) not present in the original mixture. The following table describes some possible mass building blocks, their resulting sum being equivalent to a noble metal, that could be part of the mixtures used in the present invention.

| | 1 | 2 | 3 | 4 | 5 | Mass Sum | Target Sum |
|---|---|---|---|---|---|---|---|
| Element | $1Cu^{63}$ | $1Li^{6}$ | $1S^{34}$ | | | | |
| Mass Unit | 62.930 | 6.013 | 33.968 | | | 102.911 | $Rh^{103}$ = 102.905 |
| Element | $1Cu^{63}$ | $Mg^{24}$ | $1O^{16}$ | | | | |
| Mass Unit | 62.930 | 23.985 | 15.995 | | | 102.91 | 102.905 |
| Element | $1Cu^{63}$ | $B^{11}$ | $1Si^{29}$ | | | | |
| Mass Unit | 62.930 | 11.009 | 28.975 | | | 102.914 | 102.905 |
| Element | $1Cu^{65}$ | $1Li^{7}$ | $1Cl^{35}$ | | | | |
| Mass Unit | 64.928 | 7.016 | 34.969 | | | 106.91 | $Ag^{107}$ = 106.9051 |
| Element | $1Cu^{65}$ | $1Si^{28}$ | $1N^{14}$ | | | | |
| Mass Unit | 64.928 | 27.997 | 14.004 | | | 106.929 | 106.905 |
| Element | $1Cu^{65}$ | $1Mg^{26}$ | $1O^{16}$ | | | | |
| Mass Unit | 64.928 | 25.983 | 15.995 | | | 106.906 | 106.905 |
| Element | $1Cu^{65}$ | $1Al^{27}$ | $1C^{12}$ | | | | |

-continued

| | 1 | 2 | 3 | 4 | 5 | Mass Sum | Target Sum |
|---|---|---|---|---|---|---|---|
| Mass Unit | 64.928 | 29.981 | 12.011 | | | 106.920 | 106.905 |
| Element | $1Cu^{63}$ | $1Cl^{35}$ | $1Be^{9}$ | | | | |
| Mass Unit | 62.930 | 34.969 | 9.01 | | | 106.909 | 106.905 |
| Element | $1Cu^{65}$ | $1Si^{30}$ | $1N^{14}$ | | | | |
| Mass Unit | 64.928 | 29.974 | 14.004 | | | 108.920 | $Ag^{109}$ = 108.905 |
| Element | $1Cu^{65}$ | $1Mg^{24}$ | $1Ne^{20}$ | | | | |
| Mass Unit | 64.928 | 23.985 | 19.992 | | | 108.905 | 108.905 |
| Element | $1Cu^{65}$ | $1S^{34}$ | $1Be^{9}$ | | | | |
| Mass Unit | 64.928 | 33.968 | 9.01 | | | 107.906 | $Pd^{108}$ = 107.904 |
| Element | $1Cu^{65}$ | $1Si^{29}$ | $1N^{14}$ | | | | |
| Mass Unit | 64.928 | 28.975 | 14.004 | | | 107.907 | 107.904 |
| Element | $1Cu^{65}$ | $1Si^{28}$ | $1N^{15}$ | | | | |
| Mass Unit | 64.928 | 27.977 | 15.000 | | | 107.905 | 107.904 |
| Element | $1Cu^{63}$ | $1Si^{30}$ | $1N^{15}$ | | | | |
| Mass Unit | 62.930 | 29.974 | 15.000 | | | 107.904 | 107.904 |
| Element | $2Cu^{ave}$ | $1Mn^{ave}$ | $1C^{13}$ | | | | |
| Mass Unit | 127.092 | 54.398 | 13.020 | | | 195.050 | $Pt^{ave}$ = 195.090 |
| Element | $2Cu^{ave}$ | $1B^{ave}$ | $1Be^{9}$ | $4C^{12}$ | | | |
| Mass Unit | 127.092 | 10.810 | 9.012 | 48.044 | | 194.953 | $Pt^{194}$ = 194.965 |
| Element | $2Cu^{ave}$ | $1Fe^{ave}$ | $1C^{14}$ | | | | |
| Mass Unit | 127.092 | 55.847 | 14.028 | | | 196.967 | $Au^{ave}$ = 196.967 |
| Element | $2Cu^{ave}$ | $1Be^{9}$ | 1B | $2C^{12}$ | $2C^{13}$ | | |
| Mass Unit | 127.092 | 9.012 | 10.810 | 24.022 | 26.039 | 196.975 | 196.967 |

*Note:
"Cu" =copper, "Li" = lithium, "S" = Sulfur, "Mg" = magnesium, "O" = oxygen, "Si" = silicon, "Cl" = chlorine, "N" = nitrogen, "Al" = aluminum, "C" = carbon, "Be" = beryllium, "Ne" = neon, "Mn" = manganese, "Fe" = iron, "B" = boron, "Rh" = rhodium, "Ag" =silver, "Pd" = palladium, "Pt" = platinum, and "Au" = gold.

It can be seen that this table is by no means comprehensive and it is shown only to establish a few possibilities. It also can be seen from this table that copper is a good candidate for a base metal. In addition, it can be seen from the table that feed material containing borax (an ore of boron) would work well for purposes of the present invention. Since borax is commonly used as a flux in smelting operations, and since typical induction furnaces used in smelting processes could be easily adapted to create the reaction environment (to be described below) of the present invention, it may be convenient to use the present invention to also produce noble metals during the smelting stage of metals processing.

FIGS. 1 through 5 help illustrate the reaction environment according to one embodiment of the present invention. FIG. 1 shows a schematic diagram of an electrical transmission line 10 comprising two circular conductors 12*a* and 12*b* in a parallel relationship. Each conductor has an inherent inductance associated with it that is distributed along the length of the conductor. Each conductor also has an inherent capacitance distributed between it and the parallel conductor beside it.

Figure 2:
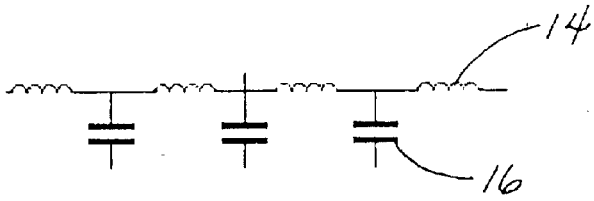
FIG. 2 is a circuit diagram that represents the electrical equivalent of the parallel conductors 12*a* and 12*b* shown in FIG. 1.

FIG. 2 is a circuit diagram that represents the electrical equivalent of the configuration of the parallel conductors 12*a* and 12*b*. The circuit diagram shows a series of distributed inductors 14 that represent the inductance of either of the parallel conductors 12*a* and 12*b*. The diagram also shows several capacitors 16 that represent the capacitance existing between the conductors 12*a* and 12*b*. Hence, as will be apparent to those skilled in the art, the transmission line 10 comprising conductors 12*a* and 12*b* acts as a ladder transmission line that will transport alternating current or pulses along the line 10 from end to end.

Figure 3:
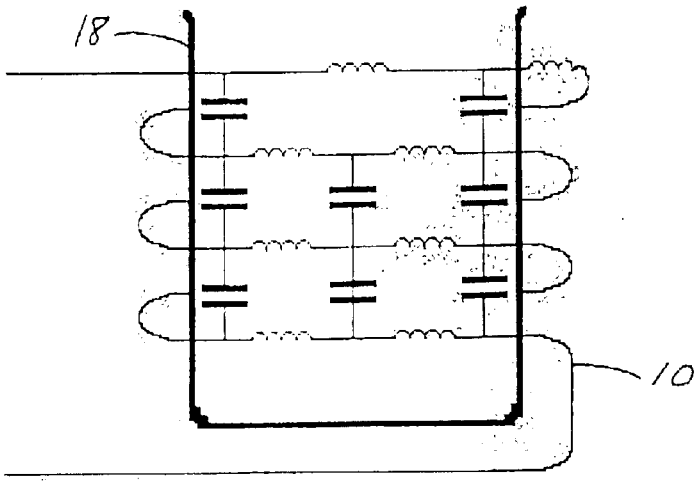
FIG. 3 schematically shows a transmission line coiled around a container in accordance with one embodiment of the present invention.

FIG. 3 schematically shows one preferred embodiment of the transmission line 10 that comprises the parallel conductors 12*a* and 12*b* shown in FIG. 1. In the preferred embodiments of the present invention, the transmission line 10 is coiled around a non-conducting, heat-resistant container 18 made of material such as alumina or zirconia. The transmission line 10, in this coiled formation, may sometimes be referred to as a "resonant structure" or "tank circuit."

Figure 4:
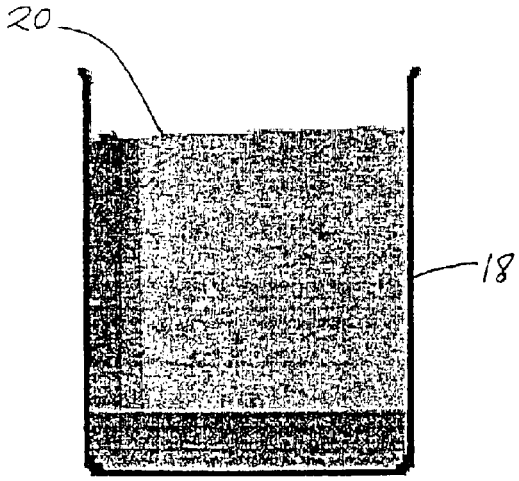
FIG. 4 shows an isolated view of a container, according to one embodiment of the present invention, filled with a mixture of feed material, base metal, and carbon.

FIG. 4 shows an isolated view of the container 18 filled with an appropriate mixture 20 of feed material, base metal, and carbon. The feed material—which contains amounts of noble metals as well as amounts of lighter elements—and the base metal are preferably in particulate or ground form and are embedded in a bed of activated carbon, or other suitable supportive material, in such a way that the particles of the base metal and the feed material are held in contact with each other as well as with the carbon when the mixture is exposed to heat.

Figure 5:
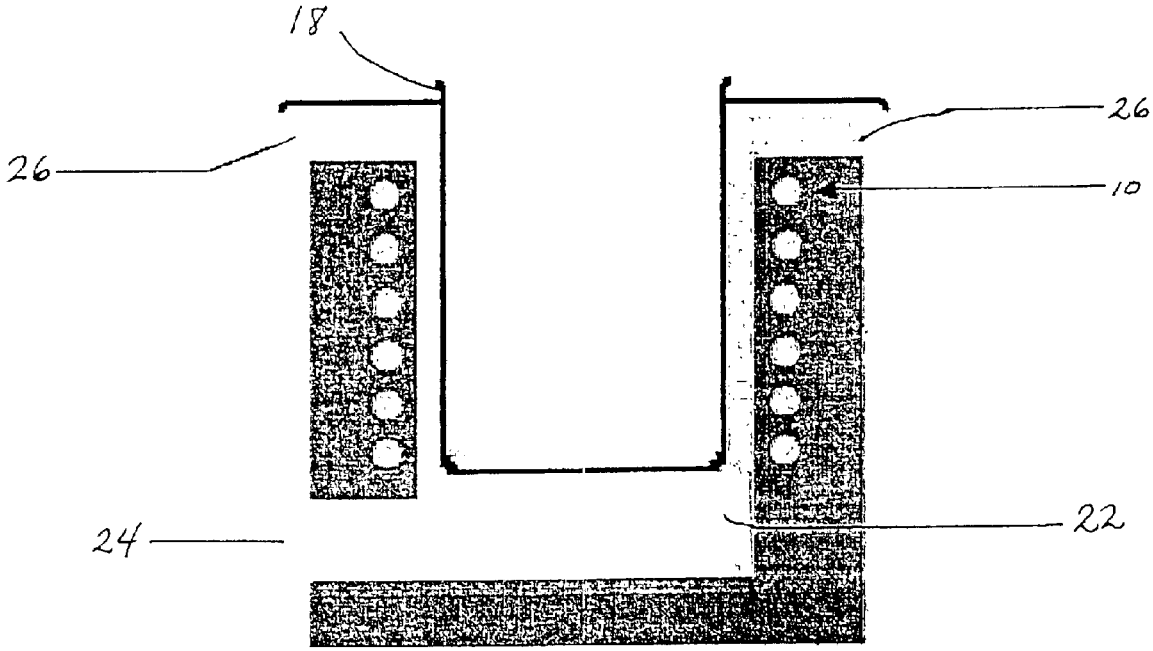
FIG. 5 shows an assembly, in accordance with some embodiments of the present invention, of the structures depicted in FIGS. 3 and 4 such that the latter structures are mounted in a combustion chamber.

FIG. 5 shows an assembly, in accordance with some embodiments of the present invention, of the structures depicted in FIGS. 3 and 4 mounted in an insulated combustion chamber 22. In the preferred embodiments of the present invention, the container 18, as well as its contents, are heated by a natural gas flame that enters the chamber 22 at a fire port 24. The heating of the container 18 and its contents can be accomplished by any of the heating methods known to practitioners of the minerals recovery art. Preferably, the top of the chamber 22 is open to the atmosphere in order to allow the atmospheric gases to enter the reaction processes ongoing within the chamber 22. Also, the combustion products from the heating flame are preferably vented away from the reaction chamber 22 through vents 26.

In operation, the present invention basically comprises placing the measured mixture 20 of feed materials, base metal, and carbon in the container 18 that is surrounded by the coiled transmission line 10. The container 18, and thus also the mixture 20 therein, is subjected to an amount of heat that increases the Brownian motion and momentum of the constituents of the mixture 20 as well as elevates the energy states of the captive electrons present in the atoms of the mixture 20. Simultaneous with the subjection of heat, pairs of electrical pulses with equal amplitude but opposing polarity (in other words, each pulse pair comprises a negative pulse and a positive pulse) are repeatedly sent through the transmission line 10. In the preferred embodiments, these pulse pairs include two types of pulse pairs, "collision pairs," and "frequency pairs."

With respect to the collision pairs, a positive pulse is applied to one end of the transmission line 10, and a negative pulse is applied to the other end of the transmission line 10 so that the pair of pulses travel towards each other and collide. Moreover, the timing of the collision pair send-offs is carefully staged so that the points of collision travel successively down one end of the transmission line 10 and back. This traveling motion of the collision points will sometimes herein be referred to as a "sweeping" motion. In addition, in the preferred embodiments, the collision pairs are interspersed between the frequency pairs, as will be explained further herein.

More particularly, in the preferred embodiments of the present invention, the pairs of electrical pulses are fed to each end of the transmission line 10 (that is, a negative pulse is applied to both of the parallel conductors 12*a* and 12*b* at one end of the transmission line 10, and a positive pulse is applied to both of the parallel conductors 12*a* and 12*b* at the other end of the transmission line 10) with enough energy that the pulses collide at some point along the transmission line 10. As will be explained further herein, it is believed that this collision creates a special electrodynamic field that extends around the collision point and into the container 18. In particular, it is believed that, based on James Clerk Maxwell's quaternion mathematics, the collision of the two pulses result in a localized, vectorless, electrodynamic field having an energy potential of twice the value of the magnitude accompanying each of the two colliding pulses, thereby resulting in a localized space-time curvature, and thereby greatly increasing the probabilities for nuclear tunneling between the atoms in the mixture 20 that are exposed to this space-time curvature.

With respect to the frequency pairs, positive and negative pulses are sent through the transmission line 10 at multiple, distinct frequencies—for example, at a frequency $f_1$, a frequency $f_2$, and a frequency $f_3$. The multiple frequencies comprise a multi-frequency chord or pulse train. For example, if the chord has three frequencies, it would be a triple chord; if it has four frequencies, it would be a quadruple chord. The multi-frequency pulse train is repeated over and over in order to sustain the multi-frequency chord, thereby exposing the mixture within the container to a multi-frequency magnetic field. Digital filters running in a digital signal processor (DSP) read the voltage levels within the transmission line 10. The digital filters will read one sine wave for each of the pulse pair frequencies, the sine waves running simultaneously with each other.

The distinct frequencies in the multi-frequency pulse train are preferably chosen to correspond to the particular noble metals desired to be obtained from the operation of the present invention. For example, if one desires to create gold, silver, and platinum from a particular mixture 20, an $f_1$, an $f_2$, and an $f_3$ would be chosen to correspond to each of the three metals. If one desires to create gold, silver, platinum, and palladium from a particular mixture 20, an $f_1$, an $f_2$, an $f_3$, and an $f_4$ would be chosen to correspond to each of those four metals (note that the four frequencies would make the pulse train a quadruple chord). Hence, the pulse train of the present invention may be a triple chord, a quadruple chord, or another multiple chord, depending on the number of noble metals that one desires to obtain.

Additionally, each frequency, $f_1$, $f_2$, $f_3$, etc., of the pulse train is preferably chosen so that the effects of the resonant structure (that is, the coiled transmission line 10 through which the pulses travel) on the atoms in the mixture 20 are such that the atoms resonate according to multiple different frequencies corresponding to the natural resonant frequencies ("resonant" in the quantum sense, as will be explained further herein) of the desired noble metals. In other words, $f_1$ would be chosen so that the fields in the mixture 20 would resonate atoms at the resonant frequency of the first desired noble metal; $f_2$ would be chosen so that the fields in the mixture 20 would resonate atoms at the resonant frequency of the second desired noble metal; $f_3$ would be chosen so that the fields would resonate atoms in the mixture 20 at the resonant frequency of the third desired noble metal; and so forth. The presently preferred frequencies are those ranging from 5000 cycles per second to 7000 cycles per second.

In order to maintain the chord of frequencies, the currents and voltages in the resonant structure are monitored, and digital signal processing (DSP) filters are applied to these currents and voltages, thereby obtaining individual wave forms for each of the specific chord frequencies. These wave forms are then used to fine-tune the power and timing of the pulse pairs such that the chord of frequencies may be indefinitely maintained within the resonant structure, as explained previously. Preferably, the structure is tuned to an intermediate frequency centered within the chord, and the structure is designed with a low enough Q such that it will support all of the frequencies of the chord. In addition, it is preferable that the amount of carbon present in the mixture 20 is enough to spoil the Q of the resonant structure such that the structure can electrically maintain the specific frequencies. It will be noted that the power supply required to generate the pulse pairs is similar to the power supply used for a typical induction furnace, except that the control system of the present invention is much more sophisticated.

A preferred embodiment of the present invention is illustrated by FIGS. 6 and 7. FIG. 6 shows a circuit diagram that helps explain how the pulses are generated in the preferred embodiments of the present invention. Shown are switches 31, 32, 33, 34, and 35. Also shown are resonance capacitors 36 that are coupled to the conductors 12*a* and 12*b* of the transmission line 10, the coupling of the capacitors 36 thus providing an electrodynamic environment suitable for the operation of the preferred embodiments of the present invention.

The table shown in FIG. 7 shows which switches 31–35 in FIG. 6 are closed in order to generate the pulse collision pairs and frequency pairs in the preferred embodiments. The left column in the table indicates a sequence of twelve events. Rows 1, 4, 7, and 10 represent events that comprise collision pulses. It can be seen that in each of those rows, switches 35 are open, and switches 31,32,33, and 34 are closed. Switches 31 and 32 are closed to create a collision pulse moving in one direction, and switches 33 and 34 are closed to create a collision pulse moving in the other direction. The closure of switches 33 and 34 is not necessarily timed to occur simultaneously with the closure of switches 31 and 32, as will be explained further below.

The remaining rows in the table indicate the closures of the switches 31–35 that generate the frequency pulse pairs in the preferred embodiments of the present invention. Rows 2 and 3 together represent the generation of a frequency 1 pair, rows 5 and 6 represent the generation of a frequency 2 pair, rows 8 and 9 represent the generation of a frequency 3 pair, and rows 11 and 12 represent the generation of a frequency 4 pair. Note that each of the latter rows represent an individual frequency pulse, and that, for each of the pairs, there is one positive pulse and one negative pulse.

In the preferred embodiments, the events occur in the order designated by the row numbers in the table. This sequence of events is repeated over and over again, resulting in the maintenance of a multi-frequency chord interspersed with momentary pulse collisions. The generating of pulses as well as the heating of the mixture 20 continues until the desired amount of noble metals are produced. The degree of the heat depends on the length of time that the heat is applied to the mixture 20. In some embodiments of the present invention, the degree of heat ranges from 1200 degrees F. to 3600 degrees F. However, of course, the degree of heat can be any degree that can achieve the desired results of the present invention.

As was mentioned earlier, the pulse collisions are timed so that the collisions sweep along the length of the transmission line 10. In the preferred embodiments, this sweeping motion is accomplished by delaying the closure of switches 33 and 34 from the closure of switches 31 and 32 in successively varying increments of time. In one embodiment, the variable delay of switches 33 and 34 is followed by the variable delay of switches 31 and 32. Specifically, the variable delay of the closure of switches 33 and 34 causes the pulse collisions to move from the center of the transmission line 10 out to one end and back to the center.

By so delaying the closure of switches 33 and 34, it can be seen that collisions can be made to occur over only half of the line because, when the opposing pulses are transmitted simultaneously, the pulses collide in the center of the transmission line 10. Therefore, in this embodiment, after the collisions have returned to the center of the transmission line 10, the order of pulse generation is switched so that the closure of switches 33 and 34 are then followed by variably delaying the closure of switches 31 and 32. This results in the collisions traveling down the opposite end of the transmission line 10 and back again to the center. The order of pulse generation continues to switch back and forth as pulse pairs are repeatedly generated. It should be noted that the delay between each pulse within a collision pulse pair may be referred to as a "variable delay." It is this variable delay that causes the before-mentioned sweeping motion of the collision points, which sweeping motion apparently causes multiple areas of the mixture 20 to be exposed to the localized space-time curvature that accompanies each pulse collision.

The frequency pairs are timed to begin at increasing voltage points on the sine wave function that define each frequency of the chord as the wave functions are filtered by digital filters running in the Digital Signal Processor (DSP). The trigger point of the pulses determine how much power is fed to the resonant structure supporting each of the frequencies. For example, if each of the pulses in a pair are short in duration, then very little power is fed to the structure; if the pulses are long, then maximum power is fed to the resonant structure. The time between the pulse pairs and the resonance of the tank circuit formed by conductors 12*a* and 12*b* and capacitors 36 determines the frequencies that will be generated and thereby the magnetic fields that influence the wave functions and nuclear resonances of the participating materials in the mixture 20.

A description of the generation and maintenance of an exemplary triple-chord pulse train, described with reference to FIGS. 6 and 7, follows:

1) After the collision pair collides as a result of the event represented by row 1 in the table of FIG. 6, switches 35 are closed, and at the point when the voltage wave form of $f_1$ crosses the voltage zero point in the positive direction, as determined by the filter for $f_1$ running in the DSP, on and off trigger points for switches 32 and 34 are selected (row 2 in the table), depending on the amount of power desired to be applied to the resonant structure for $f_1$. The pulse generated by switches 32 and 34 is then followed by a pulse generated by switches 31 and 33 (row 3 in the table), the latter pulse being timed to turn on and off during the negative half of the voltage wave form of $f_1$, the length and trigger points again being dependent on the amount of power desired to be applied to the resonant structure for $f_1$. The delay between the send-offs of the pulse created by closing switches 32 and 34 and the pulse created by closing switches 31 and 33 is set to keep the period of $f_1$ constant at the desired frequency $f_1$.
2) After a time period of $1/f_1$ passes, and at the time that the averaged voltages of all three frequency wave forms is at a minimum (that is, the voltage wave forms of all three frequencies are approaching or have just left zero), all switches 35 are opened, and the next collision pulse (row 4 in the table) is applied to the ends of the transmission line 10 formed by conductors 12*a* and 12*b*. This time period is very short compared to the periods of $f_1$, $f_2$, and $f_3$.
3) Switches 35 are closed again, and at the point when the voltage wave form of $f_2$ crosses the voltage zero point in the positive direction, as determined by the filter for $f_2$ running in the DSP, on and off trigger points for switches 32 and 34 are selected (row 5 in the table), depending on the amount of power desired to be applied to the resonant structure for $f_2$. The pulse generated by switches 32 and 34 is then followed by a pulse generated by switches 31 and 33 (row 6 in the table), the latter pulse being timed to turn on and off during the negative half of the voltage wave form of $f_2$, the length and trigger points again being dependent on the amount of power desired to be applied to the resonant structure for $f_2$. The delay between the send-offs of the pulse created by closing switches 32 and 34 and the pulse created by closing switches 31 and 33 is set to keep the period of $f_2$ constant at the desired frequency $f_2$.
4) After a time period of $1/f_2$ passes, and at the time that the averaged voltages of all three frequency wave forms is at a minimum, all switches 35 are opened, and the next collision pulse (row 7 in the table) is applied to the ends of the transmission line 10 formed by conductors 12*a* and 12*b*.
5) Switches 35 are again closed, and at the time when the voltage wave form of $f_3$ crosses the voltage zero point in the positive direction, as determined by the filter for $f_3$ running in the DSP, on and off trigger points for switches 32 and 34 are selected (row 8 in the table), depending on the amount of power desired to be applied to the resonant structure for $f_3$. The pulse generated by switches 32 and 34 is then followed by a pulse generated by switches 31 and 33 (row 9 in the table) which is timed to turn on and off during the negative half of the voltage wave form of $f_3$, the length and trigger points again being dependent on the amount of power desired to be applied to the resonant structure for $f_3$. The delay between the send-offs of the pulse created by closing switches 32 and 34 and the pulse created by closing switches 31 and 33 is set to keep the period of $f_3$ constant at the desired frequency $f_3$.
6) After a time period of $1/f_3$ passes, and at the time that the averaged voltages of all three frequency wave forms is at a minimum, all switches 35 are opened, and the next collision pulse is applied to the ends of the transmission line 10, and the sequence described in (1) through (6) is repeated over and over, thus maintaining the pulse collisions and the chord of frequencies indefinitely.

Non-relativistic quantum mechanics may help explain why the present invention produces a significantly greater quantity of noble metals than present in the original mixture 20 of feed materials, carbon, and base metal. (Relativistic mechanics is not necessary here because the processes involved in the present invention do not involve velocities anywhere near the speed of light—and hence, only insignificant amounts of mass are converted into energy, and vice versa.) According to quantum mechanics, even though a given nucleus may not have enough energy to overcome the potential energy barrier created by coulomb forces, there is still some possibility that the nucleus will nevertheless "tunnel" through the barrier to be able to merge with another nucleus. This probability of tunneling can be increased in several ways. One way is by increasing the energy or momentum of the nuclei. Another way is by placing the nuclei to be merged in such a state that both of their wave functions (quantum mechanics describes matter in terms of wave functions having discrete energy quanta, positional location quanta, and momentum quanta probabilities) are in resonance.

The present invention endeavors to appropriate both of the above-mentioned means to greatly increase the probability of nuclear tunneling. In particular, the present invention seeks to raise the momentum and energy states of nuclei by a combination of applying heat to the mixture 20 and by applying, via the sweeping pulse collisions, a series of localized space-time curvatures to the mixture 20. The present invention also seeks to place nuclei in a state of wave function resonance by providing pulses at specific frequencies so that the mixture 20 is exposed to varying electromagnetic fields that couple energy into the nuclei to cause the nuclei to resonate at the natural resonant frequencies of the desired noble metals.

To elaborate on the physics of the space-time curvatures, it should be explained that a localized point of space-time curvature theoretically causes nuclei at that point to experience significantly increased energy levels and significantly decreased potential barriers. According to James Clerk Maxwell's quaternion field mathematics, the result of combining two electromagnetic fields that have equal amplitudes but opposite directions and phases is a scalar quantity of twice the value of the opposing amplitudes. Although this scalar quantity has an amplitude of twice the amplitude of the directional quantities, this quantity nevertheless has no direction associated with it (in other words, it is vectorless), and thus might be considered a doubled potential in terms of quantum mechanics. This quantity might alternatively be deemed a curvature in local space-time. If time is not a linear function at a particular localized point, then the wave equations for that point become four-dimensional and the probabilities computed for tunneling are vastly changed from those appropriate for a three-dimensional situation. In applying quaternion math to the present invention, it would appear that the colliding of electric pulses of equal amplitude but opposite directions and phases creates localized space-time curvatures, or, in other words, changes the localized nuclei energies and potential barriers so as to significantly promote nuclear tunneling.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A method comprising:

providing a mixture comprising feed material and a base metal;

placing said mixture in a non-conductive container surrounded by a coiled electrical transmission line having a first end and a second end;

supplying to said ends of the transmission line a pair of electrical collision pulses that travel in opposite directions until they collide at a point along the transmission line;

transmitting through said transmission line a pair of frequency pulses at two or more distinct frequencies; and repeating said steps of supplying and transmitting until a desired amount of a valuable metal is produced from said mixture.

2. The method of claim 1 wherein said mixture further comprises carbon.

3. The method of claim 1 wherein said base metal comprises copper.

4. The method of claim 1 wherein said feed material comprises at least trace amounts of a noble metal.

5. The method of claim 1 wherein said mixture comprises a quantity of atoms whose masses sum up to the equivalent of a quantity of noble metal atoms.

6. The method of claim 1 further comprising heating said container and said mixture via a gas furnace.

7. The method of claim 1 wherein said transmission line comprises two parallel conductors.

8. The method of claim 1 wherein said pair of collision pulses have equal amplitudes.

9. The method of claim 1 wherein said step of supplying results in said point of collision moving successively along the transmission line in a sweeping motion.

10. The method of claim 1 wherein said frequencies consist of three frequencies.

11. The method of claim 1 wherein said frequencies range from 5000 cycles per second to 7000 cycles per second.

12. The method of claim 1 wherein said frequencies are chosen to cause atoms in the mixture to resonate at the natural frequency of the nuclei of said valuable metal.

13. The method of claim 1 further comprising variably delaying the collision pulses.

14. The method of claim 1 further comprising monitoring the waveforms of said frequencies with a digital signal processor.

15. A method comprising:

receiving, in a container surrounded by a coiled electrical transmission line having a first end and a second end, a mixture of carbon, a base metal, and a feed material;

supplying repeatedly to said ends of the transmission line a pair of electrical collision pulses that travel in opposite directions until they collide at a point along the transmission line, said point of collision moving successively in a sweeping motion along the transmission line; and transmitting repeatedly, until a desired amount of noble metal is produced, a pair of frequency pulses via a sequence of multi-chord pulse trains.

16. The method of claim 15 further comprising heating said container and said mixture via a gas furnace.

17. The method of claim 15 wherein said transmission line comprises two parallel wires.

18. The method of claim 15 wherein said multi-chord pulse trains each comprise two frequencies.

19. The method of claim 15 wherein said multi-chord pulse trains each comprise four frequencies.

20. The method of claim 15 wherein said multi-chord pulse trains each comprise two or more frequencies chosen to cause atoms in the mixture to resonate at the natural frequency of the nuclei of said noble metal.

21. The method of claim 15 further comprising variably delaying the collision pulses.

22. The method of claim 15 further comprising fine-tuning the power and timing of the frequency pulses so that said multi-chord pulse trains may be indefinitely maintained.

23. The method of claim 15 wherein said container comprises a substantially non-conductive material.

24. A method comprising:

providing a mixture of activated carbon, copper, and a particulate feed material comprising at least trace amounts of a noble metal, said mixture comprising a quantity of atoms whose masses sum up to the substantial equivalent of a quantity of atoms of said noble metal;

placing said mixture in a non-conductive container surrounded by a coiled electrical transmission line having a first end and a second end, said transmission line comprising two parallel wires;

heating said container and said mixture via a gas furnace;

supplying repeatedly to said ends of the transmission line a pair of electrical collision pulses that have equal amplitudes and travel in opposite directions until they collide at a point along the transmission line, said point of collision moving successively in a sweeping motion along the transmission line; and transmitting, until a desired amount of said noble metal is produced, a pair of frequency pulses at two or more distinct frequencies.

25. The method of claim 24 wherein said frequencies range from 5000 cycles per second to 7000 cycles per second.

26. The method of claim 24 wherein said frequencies consist of three frequencies.

27. The method of claim 24 wherein said frequencies consist of four frequencies.

28. The method of claim 24 wherein said frequencies are chosen to cause atoms in the mixture to resonate at the natural frequency of the nuclei of said noble metal.

29. The method of claim 24 further comprising variably delaying the collision pulses.

30. The method of claim 29 further comprising fine-tuning the power and timing of the frequency pulses so that said multi-chord pulse trains may be indefinitely maintained.

31. An apparatus comprising:

a substantially non-conductive container suitable for holding a mixture comprising feed material;

an electrical transmission line coiled around said container;

a power supply that repeatedly supplies pairs of frequency pulses and pairs of collision pulses to said transmission line, said collision pairs comprising pulses of opposing polarity; and a signal processor for timing said frequency pulses so that said frequency pulses are transmitted along said transmission line at two or more given frequencies until a desired amount of a noble metal is produced from said mixture.

32. The apparatus of claim 31 wherein said transmission line comprises two parallel conductors.

33. The apparatus of claim 31 further comprising a combustion chamber for heating said mixture, said combustion chamber surrounding said container.

34. An apparatus comprising:

a container suitable for holding a mixture comprising feed material and carbon;

an electrical transmission line coiled around said container;

a combustion chamber for heating said mixture, said chamber surrounding said container;

a power supply that repeatedly supplies pairs of frequency pulses and pairs of collision pulses to said transmission line, said collision pairs comprising pulses of equal amplitude and opposing polarity that collide at some point along the transmission line; and a signal processor for timing said frequency pulses so that said frequency pulses are transmitted along said transmission line at two or more given frequencies until a desired amount of a noble metal is produced from said mixture.

35. The apparatus of claim 34 wherein said container is substantially non-conductive.

36. The apparatus of claim 34 wherein said transmission line comprises two parallel conductors.

37. The apparatus of claim 34 wherein said power supply intersperses the collision pairs between the frequency pairs.

* * * * *